US007165653B2

(12) United States Patent
Rennetaud

(10) Patent No.: US 7,165,653 B2
(45) Date of Patent: Jan. 23, 2007

(54) ELEVATOR GEARLESS TRACTION MACHINE CONSTRUCTION

(75) Inventor: Jean-Marie Rennetaud, Fox Valley Gardens, IL (US)

(73) Assignee: Magil Corporation, Lake Zurich, IL (US)

( * ) Notice: Subject to any disclaimer, the term of this patent is extended or adjusted under 35 U.S.C. 154(b) by 69 days.

(21) Appl. No.: 10/993,043

(22) Filed: Nov. 19, 2004

(65) Prior Publication Data

US 2006/0151251 A1 Jul. 13, 2006

(51) Int. Cl.
*B66B 11/08* (2006.01)

(52) U.S. Cl. ..... 187/254; 187/250; 187/288; 254/362; 254/375; 254/323; 310/90; 310/91; 310/258

(58) Field of Classification Search ..... 187/233, 187/251, 288, 404, 414; 212/76, 196; 248/637, 248/671, 674–678; 310/91, 90
See application file for complete search history.

(56) References Cited

U.S. PATENT DOCUMENTS 4,736,929 A * 4/1988 McMorris ..... 254/344
5,006,744 A * 4/1991 Archer et al. ..... 310/89
6,405,833 B1 * 6/2002 Baranda et al. ..... 187/254
6,601,828 B1 * 8/2003 Strbuncelj et al. ..... 254/266
6,663,086 B1 * 12/2003 Huang ..... 254/344

FOREIGN PATENT DOCUMENTS

EP 1531139 A1 * 5/2005

* cited by examiner

*Primary Examiner*—Kathy Matecki
*Assistant Examiner*—Stefan Kruer
(74) *Attorney, Agent, or Firm*—Barnes & Thornburg LLP

(57) ABSTRACT

A flexible construction for an elevator gearless traction drive machine having a frame that is easily adaptable to traction sheaves of differing widths and diameters while providing the necessary stability for the drive components without an additional structure. The frame is comprised of a pair of frame members joined by a plurality connecting rods. The connecting rods can be mounted in various positions based on the diameter of the sheave to avoid interference between the drive mount and suspension means. Longer or shorter connecting rods may be used based on the width of the sheave.

13 Claims, 6 Drawing Sheets

ELEVATOR GEARLESS TRACTION MACHINE CONSTRUCTION

FIELD OF INVENTION

This invention relates to elevator drives, and in particular to a universal machine frame construction.

BACKGROUND OF INVENTION

Gearless traction machines are generally driving a wide range of electric traction elevators. FIG. 1 and FIG. 2 show a typical gearless traction machine construction existing in the art. A traction sheave 10 is driving a plurality of ropes 12 having one end connected to an elevator car and the other end connected to a counterweight. The sheave 10 is rigidly mounted on a shaft 14 which rotates on bearings 16, 18 mounted in pedestals 20, 22. An electric motor 24 is generally attached to one of the pedestals 22 and drives the shaft 14 and the sheave 10. In order for the machine to be rigid, the pedestals 18, 20 are generally mounted on a massive steel structure 26 called a bedplate. Such prior art construction is displayed in Japanese patent JP2003201082, among others.

The problem inherent to this design is that the ropes 12 often interfere with the bedplate 26 when the diameter of the sheave 10 changes. This interference is shown in FIG. 2 as X when the sheave diameter is increased to the value D. The sheave diameter can vary because ropes can be of different diameters and the sheave diameter is generally a multiple of the rope diameter (approximately 40 times). Therefore, the construction described above is not flexible because certain sheave diameters are prohibited or require a specific steel structure in order to be implemented. The bedplate steel structure 26 is generally a massive welded steel assembly, making this change expensive and undesirable. Another problem is that the dimensioning of the lower steel structure also needs to be changed to accommodate sheaves of various widths. The width of the sheave can vary, depending on the number of ropes 12, which can number between 2 and 10 or more, based upon the total elevator load being moved.

An alternative construction is described in U.S. Pat. No. 4,679,661. This reference discloses a sheave that is "overhung", meaning that it is not supported at one end. This construction allows any sheave diameter to be used because the ropes do not interfere with any part of the supporting structure. However, this arrangement produces a large bending moment applied on the sheave. Therefore, the main structure needs to be very massive in order to limit deflections and stresses, leading to increased cost.

In other prior art embodiments the motor has a so-called "external rotor" (EP1411620A1, JP2002274770, DE4233759A1) but the pedestals supporting the machine are also mounted on a heavy steel structure that eventually interferes with the ropes. In addition, a major disadvantage of such external rotor construction is that the sheave diameter is dependent of the motor diameter, thus reducing the flexibility of the machine.

SUMMARY OF INVENTION

The present invention is an improved and versatile elevator machine construction allowing maximum flexibility for sheave diameters and sheave width while reducing the overall cost of the machine.

The elevator machine mount construction comprises a first frame member having a first bearing mounting aperture therein and a first plurality of holes and a second frame member having a second bearing mounting aperture therein and a second plurality of holes. The first plurality of holes and the second plurality of holes are oriented such that the holes in the first frame member and the holes in the second frame member are substantially aligned in pairs. A plurality of connecting rods is provided, each having a first end passing through one of the plurality of holes in the first frame member, and a second end passing through the substantially aligned hole in the second frame member. Fasteners are located on the first end and the second end of each of the plurality of connecting rods.

Each of the plurality of connecting rods has a first shoulder and a second shoulder positioned adjacent to the first and second frame members respectively, to separate the first and second frame members. The ends of each of the plurality of connecting rods are threaded with a nut threaded onto each end.

A spacer may be positioned about each of the plurality of the connecting rods adjacent to the outer face of the second frame member and a motor mounted on the connecting rods and separated from the second frame member by the spacer. A shaft, having a sheave, passes through bearings mounted in the apertures in the first and second frame members, with the sheave positioned between the frame members. A suspension for an elevator car is mounted on the sheave for raising and lowering the elevator car.

The plurality of connecting rods may be repositioned into alternate holes in the first and second frame members to accommodate sheaves of various diameters while preventing interference between the elevator car suspension and the connecting rods. Additionally, the length of the connecting rods may be varied to accommodate sheaves of various widths.

BRIEF DESCRIPTION OF DRAWINGS

The foregoing and other aspects of the invention will become more apparent from the following description of examples embodying the best mode of the invention taken in conjunction with the accompanying drawings which illustrate, by way of example only and not intending to be limiting, the principles of the invention. In the drawings.

DETAILED DESCRIPTION OF ILLUSTRATIVE EMBODIMENTS

Figure 3:
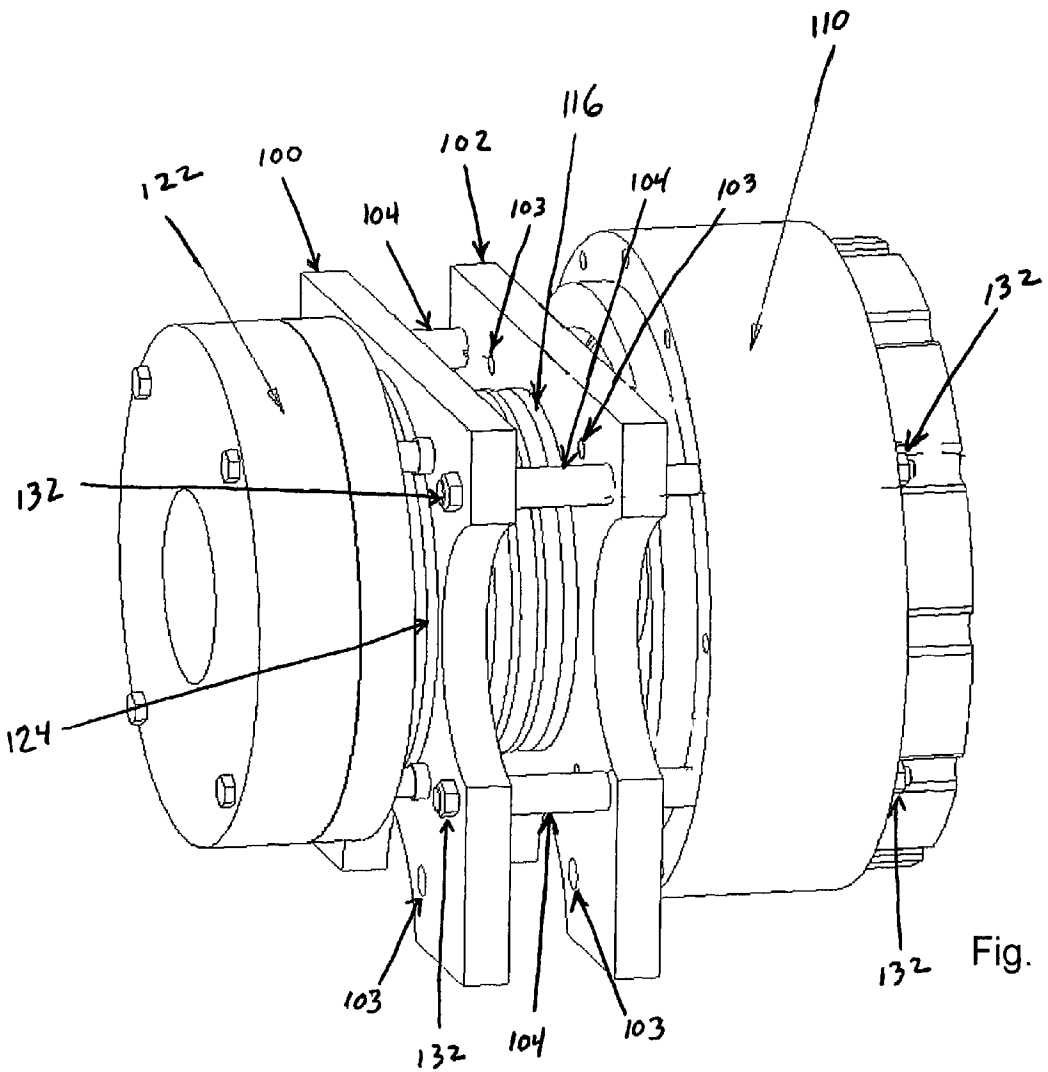
FIG. 3 is a perspective view of a machine built according to the present invention.
Figure 4:
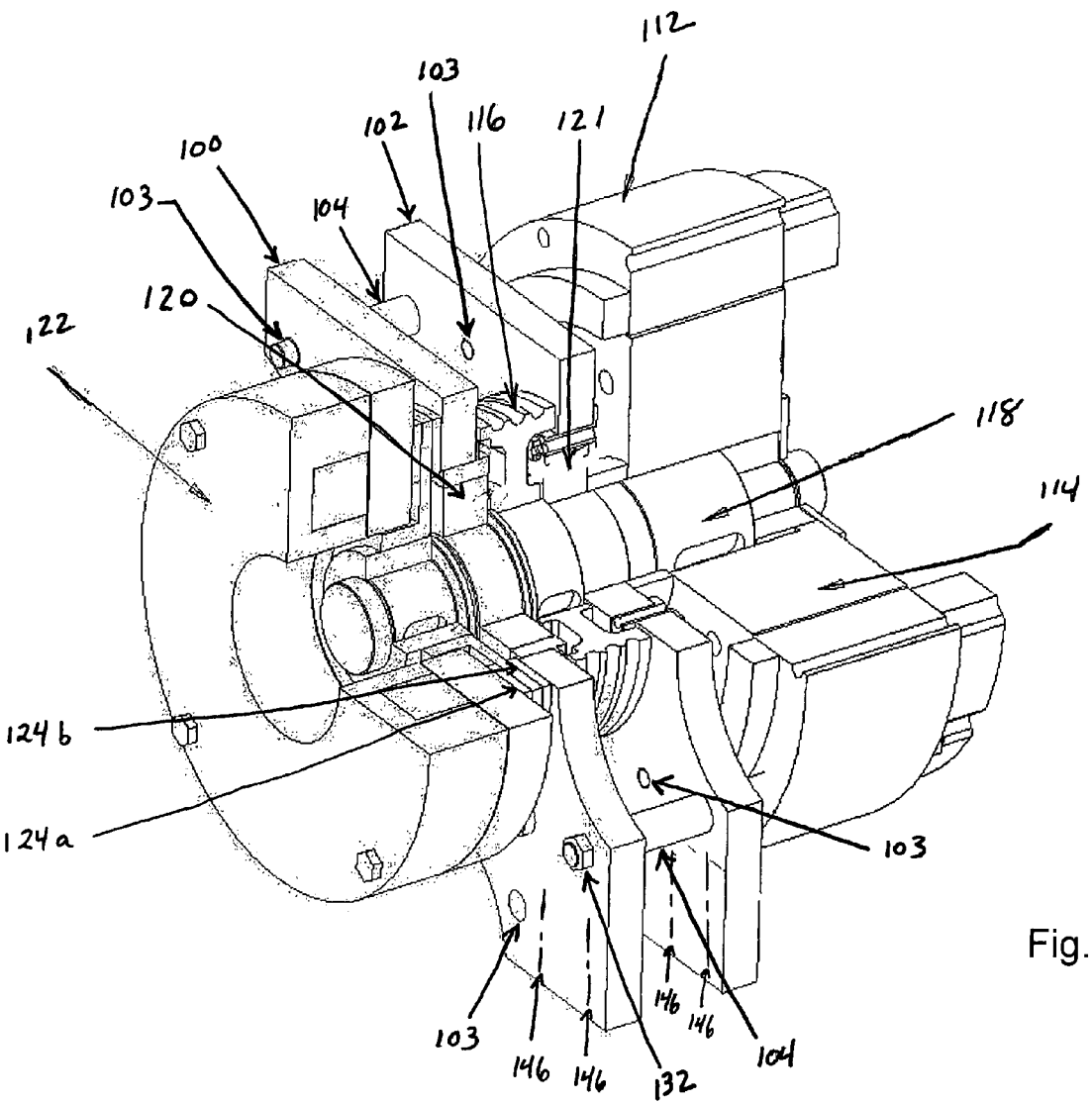
FIG. 4 is a semi sectional view of the machine illustrated in FIG. 3, showing detail.

Referring to FIG. 3 and FIG. 4, two frame members 100, 102, preferably identical, are connected by a plurality of connecting rods 104. Frame members 100, 102 are fabricated from metal such as steel plate of such thickness to provide adequate support for the machine, as will be evident to one skilled in the art. A plurality of holes 103 are drilled, or otherwise machined by means well known in the art, in frame members 100, 102 such that the holes in frame member 100 substantially align with the holes in frame member 102. Provision is also made in frame members 100, 102 for mounting bearings 120, 121 respectively to support a shaft 118. Frame members 100, 102 are then mounted to a plate 142 by means known in the art. In the preferred embodiment, the frame members 100, 102 are mounted to the plate by bolts 146.

In the preferred embodiment shown in FIG. 3 and FIG. 4, four metal connecting rods 104 are used. The same connecting rods also support the stator 112 of the motor 110. The motor 110 has a so-called "frameless" construction, meaning that the stator is not mounted in any additional frame or enclosure, as are conventional motors. A sheave 116 is attached to a shaft 118 and rotates within the frame members 100, 102 via standard bearings 120, 121. The motor's rotor 114 is connected to the shaft 118 and transmits the motor torque. A disk brake 122 is mounted on the front end of the machine with a disk brake lining 124. The disk brake lining 124 is a double face lining having a first lining 124*a* and a second lining 124*b*. To affect a braking of the machine, the first lining 124*a* is applied to the inner surface of the disk 122 and the second lining is applied to the outer surface of frame member 100.

Figure 9:
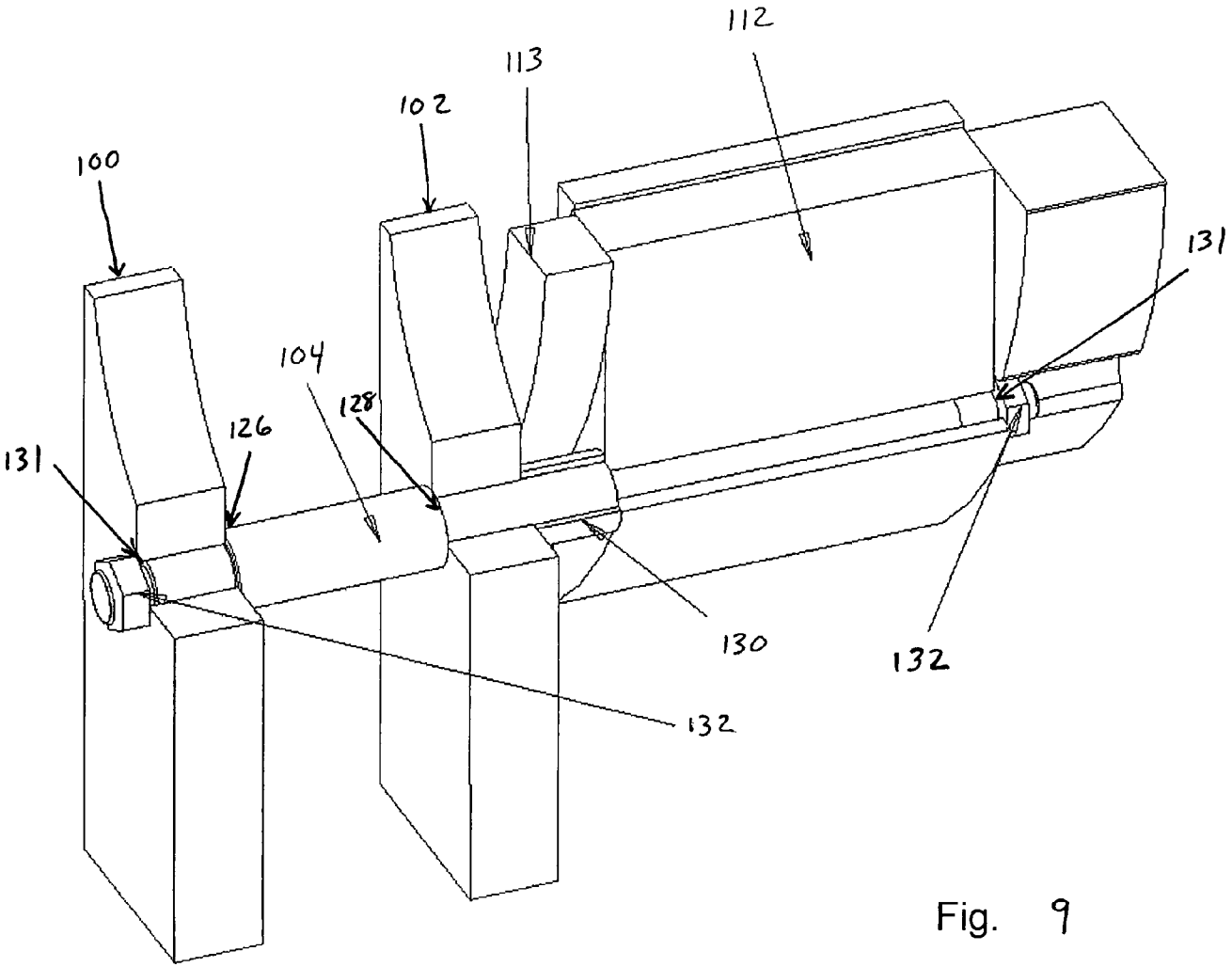
FIG. 9 is an enlarged illustration showing in detail the connecting rod assembly.

Referring to FIG. 9, the spacing between the frame members 100, 102 is realized by two shoulders 126, 128 of the connecting rods 104. The shoulders 126, 128 are machined onto the connecting rods 104 by increasing the diameter of the connecting rods 104 for a length based on the width of the sheave 116. In an alternative embodiment, a spacer bushing (not shown) may be placed about each connecting rod between frame members 100 and 102. The spacer bushings are cylinders machined from steel or other suitable material having an inside diameter and an outside diameter. The inside diameter of the spacer bushing is larger than the diameter of the connecting rod 104 such that the connecting rod 104 passes through the inside diameter of the spacer bushing. The spacer bushings would then be sized to a length to accommodate the width of the sheave 116.

Additional spacers 130 mounted on the connecting rods 104 allow the coils 113 of the stator 112 to have sufficient clearance from the innermost face of the rear frame member 102. Spacers 130 are cylinders machined from steel or other suitable material having an inside diameter and an outside diameter. The inside diameter of the spacer is larger than the diameter of the connecting rod 104 such that the connecting rod 104 passes through the inside diameter of the spacer 130. Each end of a connecting rod 104 is threaded at 131 to accommodate nuts 132. Finally, nuts 132 are tightened on each end of the connecting rods 104 in order to form a rigid assembly.

The sheave 116 can be designed to drive conventional sisal core ropes, synthetic ropes or flat belts, among other suspension means, to fulfill modern elevator requirements. In order to adapt to this wide variety of suspension means the sheave diameter can vary from approximately 4 inches to approximately 21 inches and the sheave width from approximately 1½ inches to approximately 14 inches. Accommodation of such wide variation of sheave diameters and widths is easily achieved with the present invention. By changing the length of the connecting rods 104, and the length of the shaft 118, any sheave width is acceptable. Additionally, the connecting rods 104 may be positioned at various locations by placing the connecting rods in appropriate holes in the frame members 100, 102 so that no interference exists between the ropes (or other suspension means) and any part of the machine for any sheave diameter.

In addition to ropes, the present invention may be used with other suspension means known in the art. For example FIG. 5 through FIG. 8 show a machine built from the teachings of the present invention driving a flat belt 140.

Figure 5:
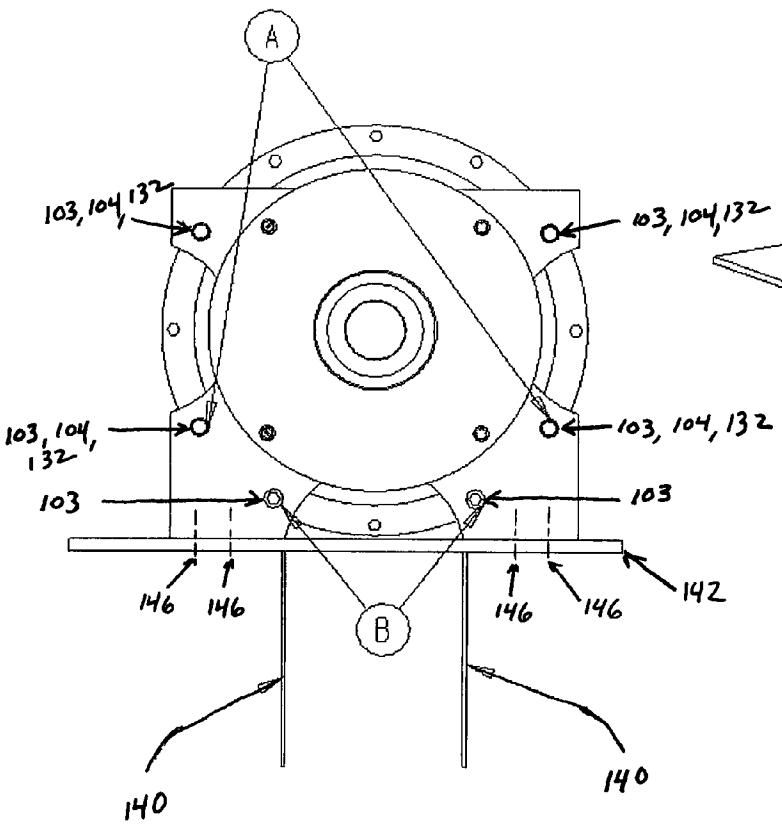
FIG. 5 shows an end view of a machine driving an elevator via a flat belt and a relatively smaller sheave.
Figure 7:
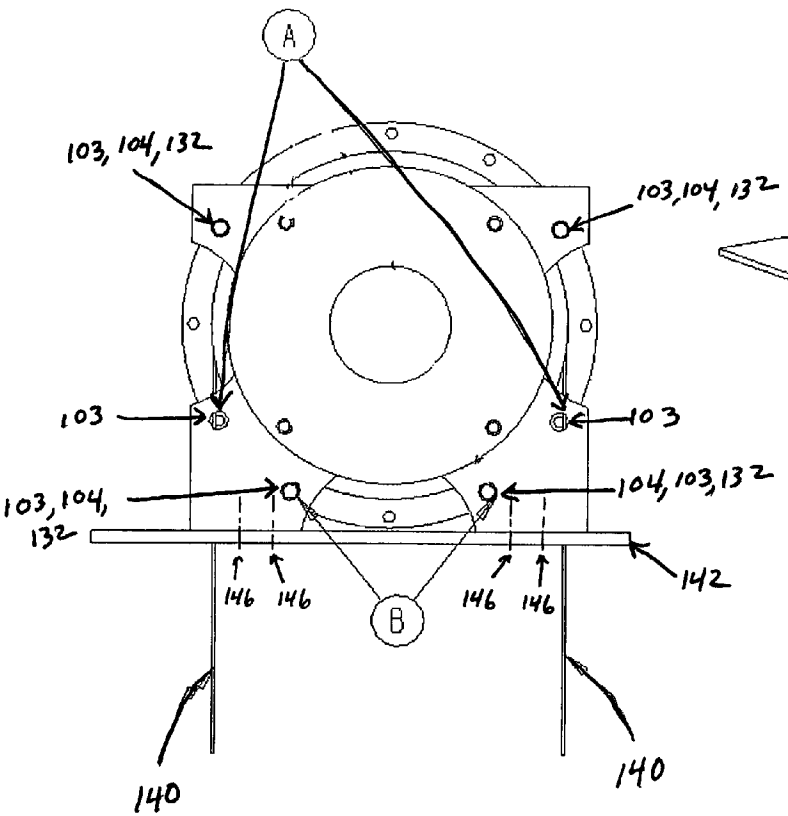
FIG. 7 shows an end view of a machine driving an elevator via a flat belt and a relatively larger sheave.

FIG. 5 and FIG. 7 show two possible locations for positioning connecting rods 104 in the lower portions of frame members 100, 102. In the A position, the connecting rods 104 are installed in the lower portions of frame members 100, 102 at a distance from the center line of the shaft 118 such that the ropes, flat belts, or other suspension means pass inside the connecting rods 104. In the B position, the connecting rods 104 are installed in the lower portions of frame members 100, 102 are installed at a distance from the center line of the shaft 118 such that the ropes, belts, or other connecting means pass outside the connecting rods 104. By adjusting the position of the connecting rods depending on the sheave diameter, interference between the ropes, flat belt or other suspension means and the machine supporting structure is avoided entirely.

Figure 6:
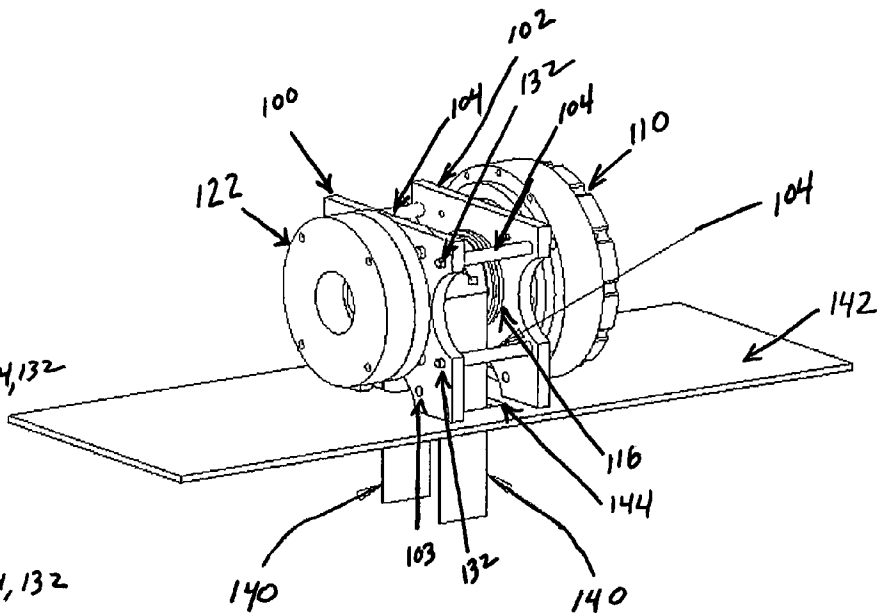
FIG. 6 shows a perspective view of the embodiment of FIG. 5.

FIG. 5 and FIG. 6 thus show an embodiment of the present invention where connecting rods 104 mounted in the A position are at a distance from the centerline of shaft 118 which is greater than the radius of the sheave 116 so that the flat belt 140 passes inside the connecting rods 104.

Figure 8:
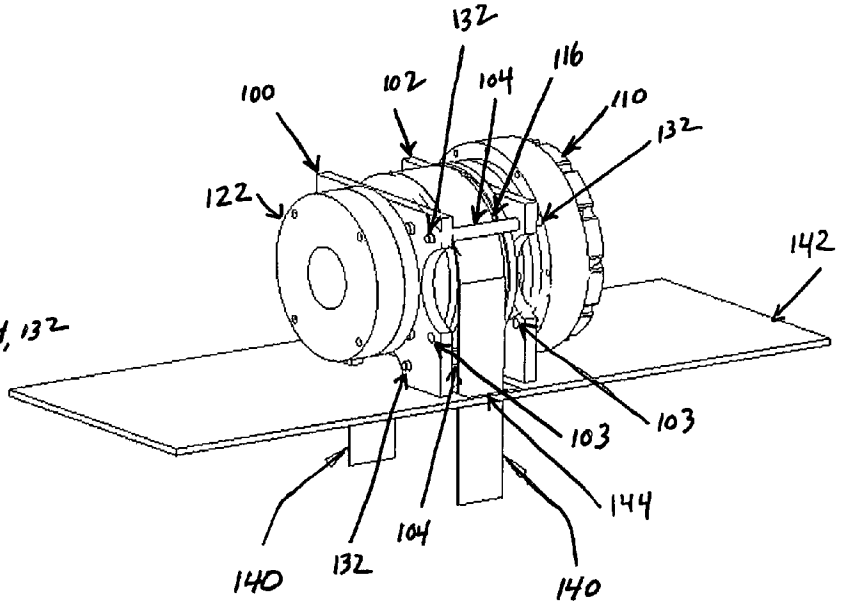
FIG. 8 shows a perspective view of the embodiment of FIG. 7.

In the embodiment shown in FIG. 7 and FIG. 8 the sheave diameter has been increased and the lower connecting rods 104 are mounted in location B to avoid interference with the suspension means which could occur if the lower connecting rods were placed at location A. In this embodiment, the connecting rods 104 are at a distance from the centerline of shaft 118 that is less than the radius of the sheave 116 so that the flat belt 140 passes outside the connecting rods 104.

Because the only parts of the machine that need to be changed are essentially of cylindrical shape and can be machined on a CNC horizontal lathe, it is very easy to adapt the machine to any requirement as opposed to prior art where complicated parts need to be changed, for example welded steel structures.

Figure 2:
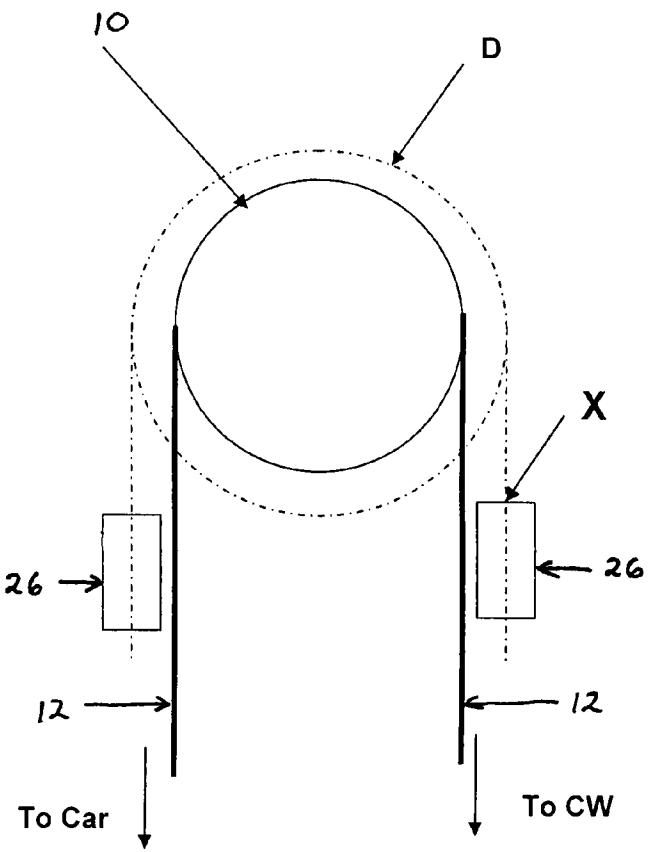
FIG. 2 is a section view of a typical arrangement taken at 2—2 in FIG. 1.
Figure 1:
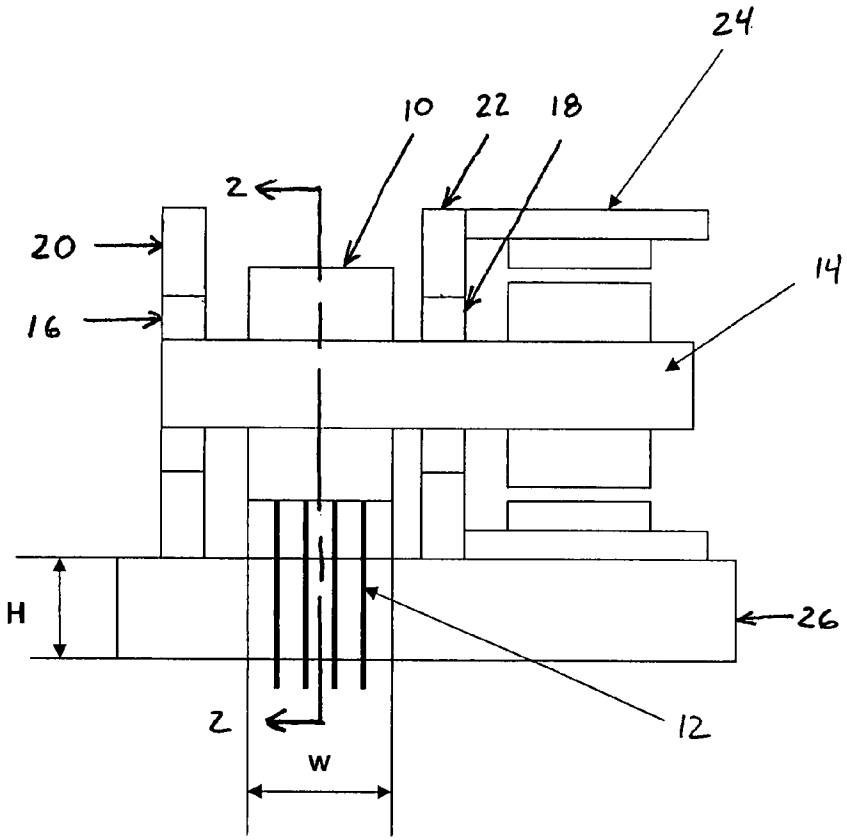
FIG. 1 schematically shows a typical arrangement of gearless elevator machine construction existing in the art.

It is also noted that in this invention the overall height of the machine has been reduced by the entire height of the steel bedplate structure used in prior art (referred to as "H" in FIG. 1), which is a substantial advantage in the particular but very popular instance of "machine room less" elevators.

In summary an innovative elevator gearless machine has been described and has the following advantages over the prior art:

Maximum flexibility: the machine of the present invention can accommodate a large spectrum of sheave diameters and sheave widths with minimum and inexpensive changes (position of connecting rods, length of connecting rods, shaft length).

Minimum number of parts: compression of motor frame and lower steel structure compared to that found in prior art.

Lower cost: expensive parts found in prior art such as cast iron pedestals or massive welded steel structures have been replaced by lower cost components (frames made out of flame cut steel plates, connecting rods).

Various changes can be made to the invention without departing from the spirit thereof or scope of the following claims.

What is claimed is:

1. An elevator machine mount comprising:

a first frame member having a first bearing mounting aperture therein and a first plurality of holes;

a second frame member, spaced from said first frame member, and having a second bearing mounting aperture therein and a second plurality of holes;

said first plurality of holes and said second plurality of holes being oriented such that the holes in said first frame member and the holes in said second frame member are substantially aligned in pairs;

a motor located proximate and in alignment with one of said frame members, said motor having a third plurality of holes each oriented substantially in alignment with each one of said pairs;

a plurality of connecting rods, each connecting rod having a first end passing through one of said plurality of holes in said first frame member, a second end passing through the substantially aligned hole in said second frame member, and one of said ends passing through the substantially aligned hole in said motor; and fasteners located on said first end and said second end of each of said plurality of connecting rods.

2. The elevator machine mount of claim 1 wherein each of said plurality of connecting rods has a first shoulder adjacent said first frame member; and a second shoulder adjacent said second frame member, said first shoulder and said second shoulder being positioned to separate said first frame member and said second frame member.

3. The elevator machine mount of claim 1 wherein a spacer bushing is positioned about each of said plurality of connecting rods between said first frame member and said second frame member.

4. The elevator machine mount of claim 1 wherein said first and second ends of said connecting rods are threaded, and wherein said fasteners comprise nuts engaged on said ends.

5. The elevator machine mount of claim 1 further including a spacer about each of said plurality of connecting rods adjacent to said second frame member.

6. The elevator machine mount of claim 2 wherein said first and second ends of said connecting rods are threaded, and wherein said fasteners comprise nuts engaged on said ends.

7. The elevator machine mount of claim 2 further including a spacer about each of said plurality of connecting rods adjacent to said second frame member.

8. The elevator machine mount of claim 6 further including a spacer about each of said plurality of connecting rods adjacent to said second frame member.

9. The elevator drive machine according to the claim 1, further including:

a shaft having a first end and a second end, passing through and supported by said a first bearing and a second bearing located in said first and second bearing mounting apertures; and a sheave forming part of said shaft.

10. The elevator machine mount of claim 9 wherein said motor is of frameless construction.

11. The elevator machine mount of claim 9 further including:

a brake mounted on said shaft opposite said motor; and a suspension for an elevator car mounted on said sheave.

12. The elevator machine mount of claim 11 wherein said suspension is one of the group consisting of sisal core ropes, synthetic ropes, steel ropes, and flat belts.

13. The elevator machine mount of claim 11 wherein said brake is a disk brake.

* * * * *